US007837811B2

(12) United States Patent
Motegi et al.

(10) Patent No.: US 7,837,811 B2
(45) Date of Patent: Nov. 23, 2010

(54) METHOD FOR MANUFACTURING A COMPOSITE OF CARBON NANOMATERIAL AND METALLIC MATERIAL

(75) Inventors: Tetsuichi Motegi, Narashino (JP); Fumi Tanabe, Narashino (JP); Masashi Suganuma, Hanishina-gun (JP); Kazuo Anzai, Hanishina-gun (JP)

(73) Assignees: Nissei Plastic Industrial Co., Ltd., Nagano-ken (JP); Chiba Institute of Technology, Chiba-ken (JP)

( * ) Notice: Subject to any disclaimer, the term of this patent is extended or adjusted under 35 U.S.C. 154(b) by 444 days.

(21) Appl. No.: 11/803,139

(22) Filed: May 11, 2007

(65) Prior Publication Data

US 2008/0127777 A1 Jun. 5, 2008

(30) Foreign Application Priority Data

May 12, 2006 (JP) ..... 2006-134175

(51) Int. Cl.
*C22B 26/22* (2006.01)
*C22B 9/02* (2006.01)

(52) U.S. Cl. ..... 148/538; 148/558; 148/666; 75/342

(58) Field of Classification Search ..... None
See application file for complete search history.

(56) References Cited

U.S. PATENT DOCUMENTS 6,860,314 B1 * 3/2005 Koide et al. ..... 164/113
7,509,993 B1 * 3/2009 Turng et al. ..... 164/97

FOREIGN PATENT DOCUMENTS

JP 06-073485 3/1994
JP 2004-098111 4/2004
JP 2004-136363 5/2004

* cited by examiner

*Primary Examiner*—George Wyszomierski
(74) *Attorney, Agent, or Firm*—Weingarten, Schurgin, Gagnebin & Lebovici LLP

(57) ABSTRACT

The present invention provides a method for manufacturing a composite of a carbon nanomaterial and a metallic material which has a homogeneous composite metal structure and thixotropic properties by compositing a metallic material of a non-ferrous metal alloy with a carbon nanomaterial by using both stirring and ultrasonic vibration. The method comprises compositing the metallic material of the non-ferrous metal alloy with the carbon nanomaterial by adding the carbon nanomaterial in a state where the metallic material shows thixotropic properties by spheroidization of solid phase in a semi-solid state, and the compositing is performed by a process for stirring and kneading the semi-solid metallic material while keeping the temperature thereof at a solid-liquid coexisting temperature, and a process for dispersing the carbon nanomaterial to liquid phase between solid phases by ultrasonic vibration.

12 Claims, 3 Drawing Sheets

METHOD FOR MANUFACTURING A COMPOSITE OF CARBON NANOMATERIAL AND METALLIC MATERIAL

This application claims priority to Japanese application No. 2006-134175 filed May 12, 2006.

BACKGROUND OF THE INVENTION

1. Field of the Invention

The present invention relates to a method for manufacturing a metallic material having a composite metal structure consisting of a non-ferrous metal alloy such as magnesium alloy or aluminum alloy and a carbon nanomaterial.

2. Description of the Related Art

The carbon nanomaterial that is one kind of crystalline carbon materials has characteristics such as having about 5 times higher heat conductivity than non-ferrous metals such as aluminum (Al) and magnesium (Mg), satisfactory electric conductivity, and excellent slidability due to low friction factor. However, the carbon nanomaterial is recommendable to be made into a composite by mixing with other substances in application thereof because it is an ultrafine material of nm scale.

A conventionally known art for compositing a metallic material with a carbon nanomaterial comprises kneading the carbon nanomaterial with a metal powder followed by pressure refining to form composite material grains having a metal powder grain size of 5 μm to 1 nm, and the composite material grains are thermally compressed by hot press molding, and processed into a product consisting of a composite metallic material. However, since the product shape is restricted in this product processing by hot press molding, this method stops short of manufacturing a metal product such as a heat radiating part or shield part for electronic equipment or a bearing which was difficult to manufacture by press molding.

Therefore, it has been tried to form a composite metallic material adaptable for a metal molding machine by perfectly melting a metallic material to a temperature of a liquidus temperature or higher, adding carbon nanomaterial to the metallic material of in the liquid phase state, and stirring and kneading the metallic material with the carbon nanomaterial by a stirring machine. However, since the carbon nanomaterial is poor in wettability with the metallic material in the liquid phase state and is difficult to be dispersed uniformly in the liquid phase due to floating by stirring, this method has not been put into practical use, so far.

As a new means for uniformly dispersing the carbon nanomaterial, it has been performed to cool a molten metallic material from a liquid state into a semi-solid state, spheroidize granular solid phase in a liquid phase which is generated in this cooling process to form a semi-solid metallic material showing thixotropic properties, and add the carbon nanomaterial thereto followed by stirring and kneading. Although this spheroidization of solid phase is performed by flowing down the metallic material over the plate surface of an inclined cooling plate in a molten state thereof, the spheroidization can be performed also by adding a crystal grain refining agent or by applying an electromagnetic vibration force or an ultrasonic vibration force.

Patent Literature 1: Japanese Patent Application Laid-Open No. 2004-136363

Patent Literature 2: Japanese Patent Application Laid-Open No. H06-73485

Patent Literature 3: Japanese Patent Application Laid-Open No. 2004-98111

Although the dispersion of the carbon nanomaterial is enhanced in the above-mentioned compositing with the metallic material in the semi-solid state, compared to the compositing with the metallic material molten to the liquid phase state, part of the carbon nanomaterial is left in lumps in the liquid phase between solid phases as it is coagulated. This is caused by the fact that the carbon nanomaterial itself is easy to coagulate, and the dispersion is limited to the liquid phase between solid phases, and the coagulation cannot be entirely broken and dispersed by the stirring by rotation of a stirring blade, and homogenization of the composite metal structure had its limit. When ultrasonic vibration is adapted as a stirring means by vibration, the carbon nanomaterial floats on the surface layer of the semi-solid metallic material by the vibration, and mostly left in the upper layer, and the resulting difference in density of the carbon nanomaterial between the upper layer and the lower layer makes it difficult to bring the composite metal structure into a homogenous state.

SUMMARY OF THE INVENTION

The present invention has been achieved to solve the above-mentioned problems. An object of the present invention is to provide a method for manufacturing a composite of a carbon nanomaterial and a metallic material suitable as a molding material for injection molding, die-cast molding or the like, which has a homogeneous composite metal structure and shows thixotropic properties in a semi-solid state by performing compositing of a metallic material with a carbon nanomaterial by using both stirring and vibration.

According to the present invention, in compositing of a metallic material of a non-ferrous metal alloy with a carbon nanomaterial by adding the carbon nanomaterial in a state where the metallic material shows thixotropic properties by spheroidization of solid phase in a semi-solid state thereof, the compositing is performed by a process for stirring and kneading the metal material of the semi-solid state while keeping the temperature thereof at a solid-liquid coexisting temperature and by a process for dispersing the carbon nanomaterial to the liquid phase between solid phases by ultrasonic vibration.

The spheroidization of solid phase in the semi-solid state of the metallic material is performed in the process of cooling the metallic material into the semi-solid state by flowing down the metallic material, after melting it by heating to a liquidus temperature or higher, over the plate surface of an inclined cooling plate. Otherwise, the spheroidization of solid phase is performed by melting the metallic material to the semi-solid state by heating to a solid-liquid coexisting temperature between a liquidus temperature or lower and a solidus temperature or higher, and shearing the solid phase by stirring the semi-solid metallic material.

The stirring and kneading process is performed by adding the carbon nanomaterial in the spheroidization process of shearing the solid phase by stirring the semi-solid metallic material.

The dispersion process by ultrasonic vibration comprises continuously or intermittently applying ultrasonic vibration for 60 to 900 seconds successively to the stirring and kneading process, and the ultrasonic vibration is applied with a frequency of 5 to 30 kHz, an ultrasonic wave output of 500 to 3000 kW, an amplitude width of 5 to 30 μm, and a vibration giving time of 60 to 900 seconds.

The non-ferrous metal alloy is a magnesium alloy, grains of solid phase of the semi-solid metallic material has a size of 50 to 300 μm, and the grains are refined to 5 to 50 μm by the ultrasonic vibration.

The carbon nanomaterial consists of a carbon nanofiber having a diameter of 10 to 150 nm and a length of 1 to 100 μm, and the addition amount of the carbon nanomaterial is 0.1 to 20 mass %. The carbon nanomaterial is preheated before added to the semi-solid metallic material.

In the above-mentioned structure, since the stirring and kneading of the metallic material with the carbon nanomaterial is performed in a semi-solid state where liquid phase and solid phase are coexistent, even the carbon nanomaterial, which is poor in wettability with the metallic material in the liquid phase state and is difficult to knead due to floating to the molten metal surface by stirring, can be easily mixed with the metallic material since the floating of the carbon nanomaterial is suppressed by limitation of its dispersion range to the liquid phase between solid phases due to the presence of spheroidized solid phase, viscosity increased by the carbon nanomaterial dispersed to the liquid phase, or the like.

Further, since the lumps caused by coagulation of the carbon nanomaterial are broken and dispersed to the liquid phase by the stirring and the application of ultrasonic vibration, and the carbon nanomaterial is entirely dispersed by extension of the dispersion range by refining of solid phase by ultrasonic vibration, a homogeneous and thixotropic composite of carbon nanomaterial and metallic material for molding, which was difficult to manufacture by conventional compositing only by stirring or ultrasonic vibration can be easily manufactured.

DESCRIPTION OF THE PREFERRED EMBODIMENT

Figure 1:
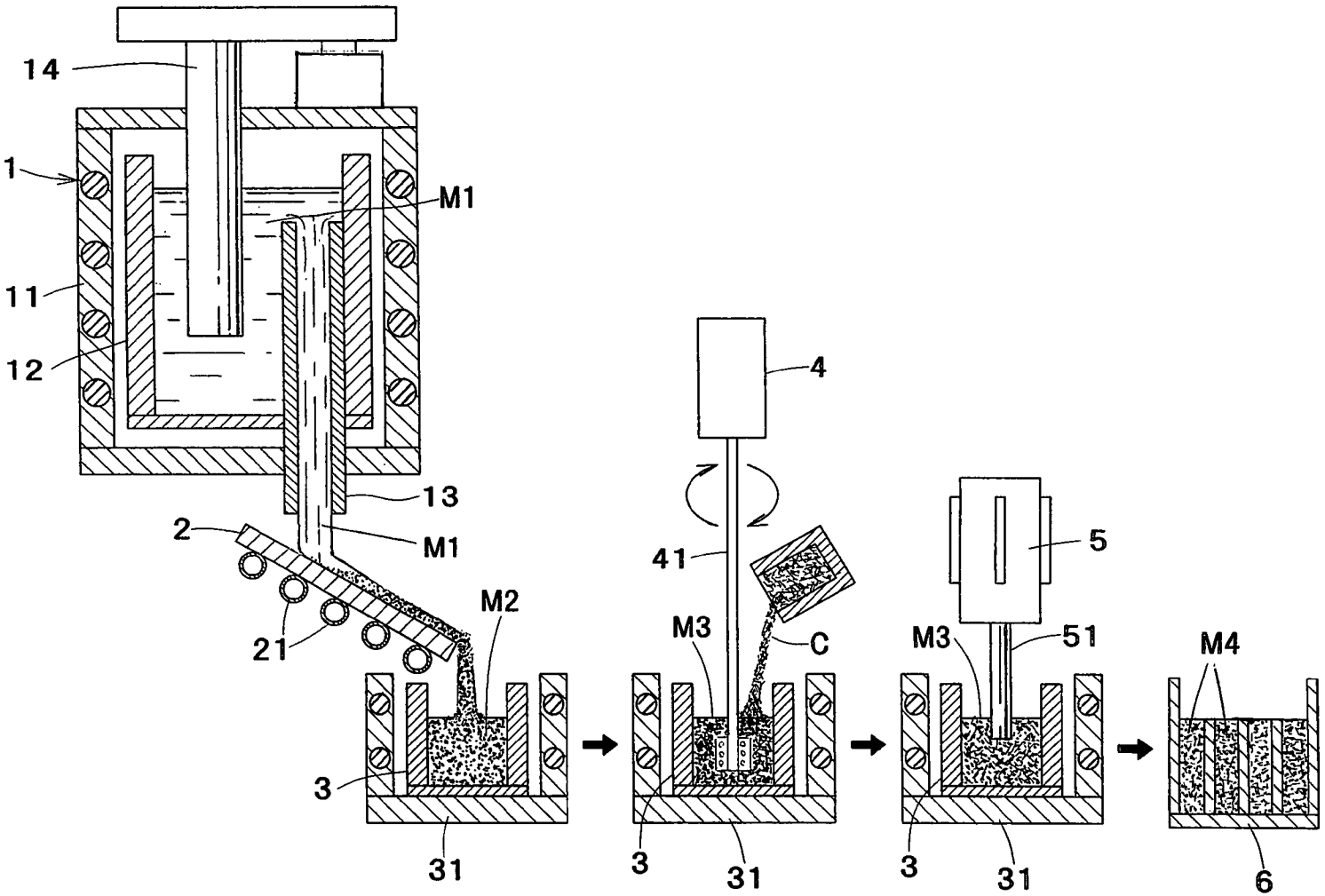
FIG. 1 is an illustrative view showing a process for manufacturing a composite of carbon nanomaterial and a metallic material according to the present invention.

FIG. 1 schematically shows a manufacturing process according to the present invention. In the drawing, denoted at 1 is a melting furnace for metallic material, which comprises a crucible 12 disposed within an electric furnace 11, a supply and discharge pipe 13 at the bottom of the crucible, and a level control rod 14 within the crucible. Denoted at 2 is an inclined cooling plate including cooling conduits 21 provided on the lower side surface, and the cooling plate is set aslant at the lower end of the supply and discharge pipe 13 of the melting furnace 1. Denoted at 3 is a movable storage container located at the lower end of the inclined cooling plate 2, and the storage container is set within an electric furnace 31 and heated to a solid-liquid coexisting temperature by the electric furnace 31. Denoted at 4 is a stirring device, and 5 is an ultrasonic vibration generator, and stirring and application of vibration can be successively performed by inserting a stirring bar 41 and a vibration hone 51 of the respective devices to the storage container 3 from above. Denoted at 6 is a mold.

The non-ferrous metal alloy in the present invention means an alloy based on any one of magnesium (Mg), tin (Sn), aluminum (Al), copper (Cu), lead (Pb), and zinc (Zn).

The manufacturing process of a composite metallic material of an alloy based on magnesium (AZ91D: liquidus temperature 595° C.) with a carbon nanomaterial will be described according to the above-mentioned process flow. The carbon nanomaterial is a carbon nanotube and a carbon nanofiber having a diameter of 10 to 150 nm and a length of 1 to 100 μm.

The melting furnace 1 is first heated to 595 to 750° C. to perfectly melt the metallic material put into the melting furnace at a liquidus temperature or higher. A fixed amount of a resulting molten metallic material $M_1$ is poured onto the upper end of the inclined cooling plate 2 through the supply and discharge pipe 13 of the melting furnace 1, and flowed down over the plate surface to the storage container 3 maintained at a semi-solid temperature at the lower end.

The molten metallic material $M_1$ is cooled to a liquidus temperature or lower in the process of flowing down over the inclined cooling plate 2. During the course, primary crystal seeds by solidification and spheroidization of a component having a high melting point of the alloy components are formed, and the molten material $M_1$ is consequently stored as a semi-solid metallic material $M_2$ showing thixotropic properties in which solid phase and liquid phase are coexistent in the storage container 3 maintained at the solid-liquid coexisting temperature. The grain size of solid phase in the storage container 3 is 50 to 200 μm (stored within 5 minutes).

The storage container 3 is then moved to the position of the stirring device 4, and the stirring bar 41 with blades is inserted into the storage container from above, and a predetermined amount (e.g., 1 mass %) of carbon nanomaterial C is added while stirring the semi-solid metallic material $M_2$ maintained at the solid-liquid coexisting temperature by the electric furnace 31. The stirring is performed for at least 10 minutes or more (rotating speed: 500-3000 rpm), including the addition time thereof. If the solid phase ratio of solids in the stirring and kneading is 10% or less, dispersion of the carbon nanomaterial is apt to be uneven because the liquid phase area in which the carbon nanomaterial is dispersed is too large and the solid phase for suppressing the floating of the carbon nanomaterial is too small. If the solid phase ratio exceeds 90%, the liquid phase area is narrowed to make the dispersion difficult.

The carbon nanomaterial C is preferably preheated (e.g., to 500° C.) prior to its addition. This preheating can arrest reduction in temperature of the semi-solid metallic material $M_2$ after the addition. The carbon nanomaterial C at the time of addition is in a coagulated state and difficult to break as it is, but dispersed, in the semi-solid metallic material, to the liquid phase between solid phases by the kneading and stirring. However, it is partially dispersed as small lumps as it is coagulated. Such lumps are never broken even if the rotating speed of the stirring bar 41 is raised or the stirring time is prolonged, and left in such a manner that they are sandwiched between solid phases.

When the stirring of the carbon nanomaterial C is ended, the stirring device 4 is replaced by the ultrasonic vibration generator 5, the vibration hone 51 is inserted into a semi-solid metallic material $M_3$ primarily composited with the carbon nanomaterial C by stirring, and ultrasonic vibration (amplitude direction: vertical) is applied to the semi-solid metallic material $M_3$. The solid phase is refined by this vibration application to increase the area of liquid phase between solid phases, and the lumps coagulated between solid phases are also broken and dispersed by the ultrasonic vibration. Consequently, the carbon nanomaterial C is uniformly dispersed.

The ultrasonic vibration applied to the semi-solid metallic material $M_3$ can be applied with a frequency of 5 to 30 kHz, an ultrasonic output of 500 to 3000 kW, an amplitude of 5 to 30 μm, and an application time of 60-900 seconds, and the application of ultrasonic vibration can be performed continuously or intermittently. Depending on the breaking state of the coagulation, repetitive intermittent application of ultrasonic vibration may be preferred. In the semi-solid metallic material $M_3$ to which the ultrasonic vibration is applied, grains of solid phase are refined to 5 to 50 μm.

After the lapse of a set time, the semi-solid metallic material $M_3$ composited with the carbon nanomaterial C is poured into the mold 6 and cast into a metallic material $M_4$ for molding process of a short columnar shape (bar), an ingot or the like.

Figure 2:
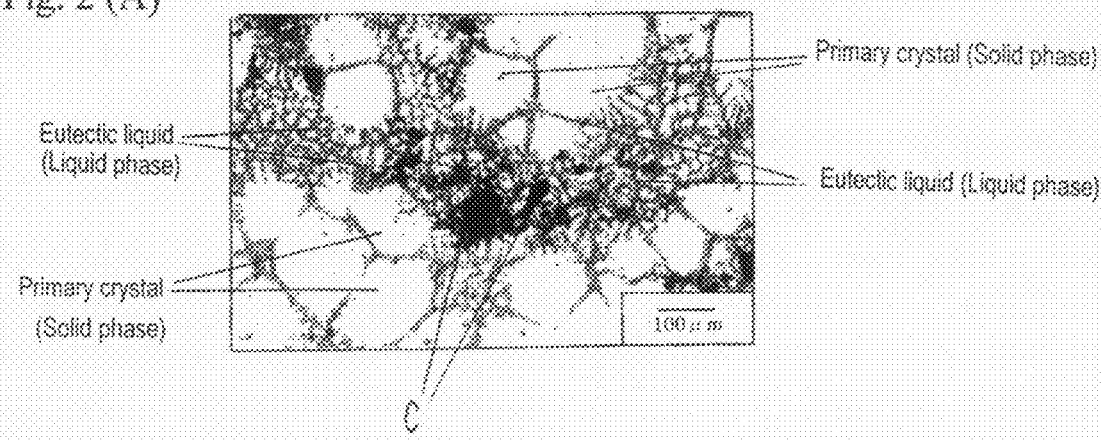
FIG. 2 are microphotographs of composite metal structure of an intermediate only through a stirring and kneading process.
Figure 2:
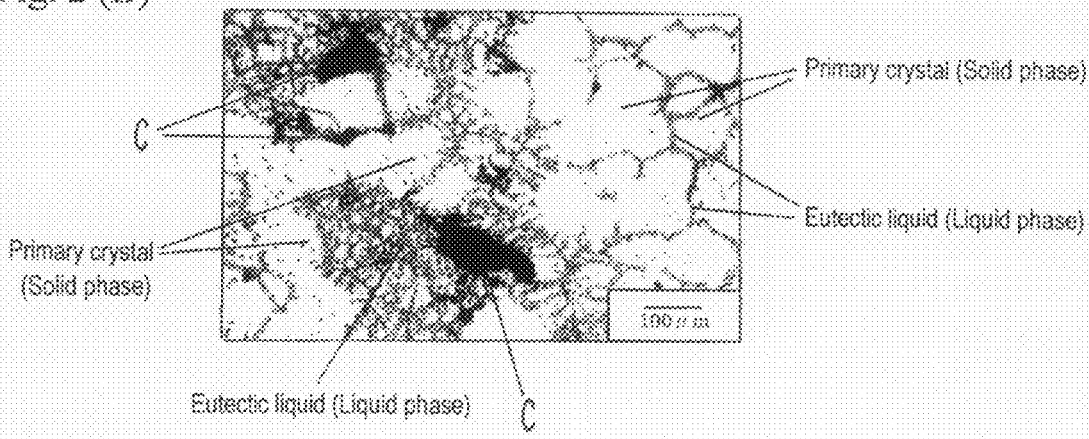
Figure 2:
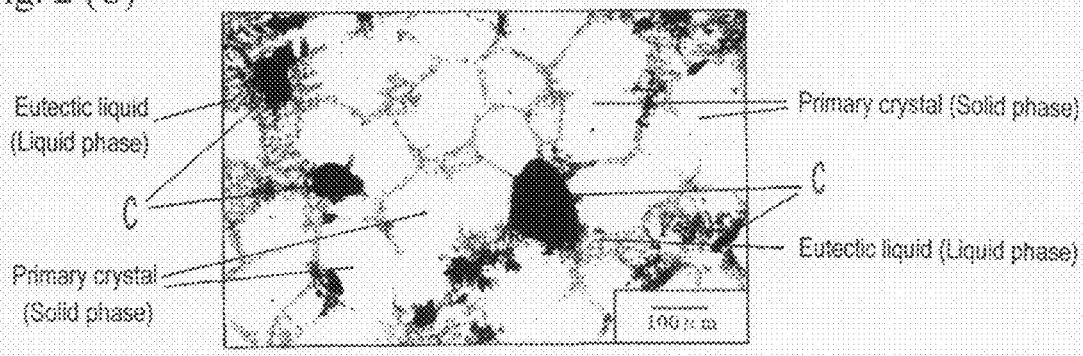

FIG. 2 are micrographs of composite metal structure of an intermediate produced only through the stirring and kneading process, which is manufactured by stirring and kneading the carbon nanomaterial within a cylindrical container (diameter: 60 mm, height: 200 mm) (stirring time: 60 minutes, rotating speed: 500 rpm) and then solidifying it by cooling into a short columnar shape.

FIG. 2(A) shows the composite metal structure in a section of a ¼ part from the upper part of the intermediate, FIG. 2(B) shows the composite metal structure in a section of a part ½ from the upper part, and FIG. 2(C) shows the composite metal structure in a section of a part ¾ from the upper part. As is apparent from these composite metal structures, the carbon nanomaterial C is left as lumps (black part) by coagulation in eutectic liquid between primary crystals (solid phases) even if stirring is performed over 60 minutes in the stirring and kneading process.

Figure 3:
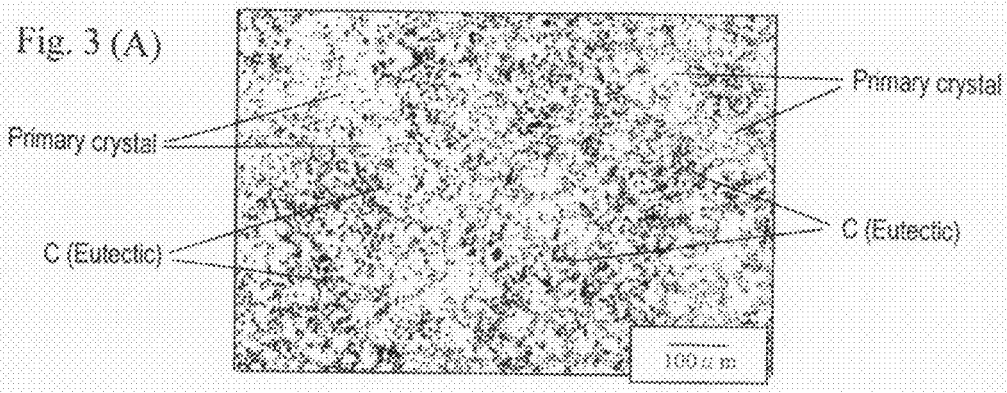
FIG. 3 are microphotographs of composite structure of a composite of carbon nanomaterial and a metallic material manufactured through the stirring and kneading process and a dispersion process by ultrasonic vibration according to the present invention.
Figure 3:
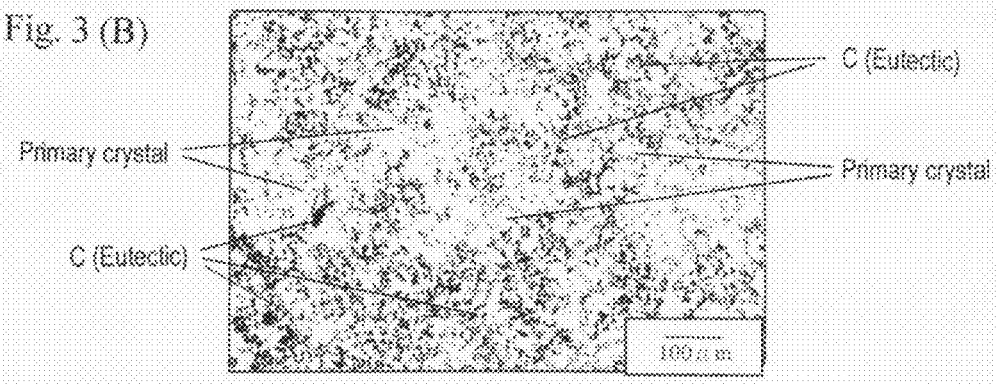
Figure 3:
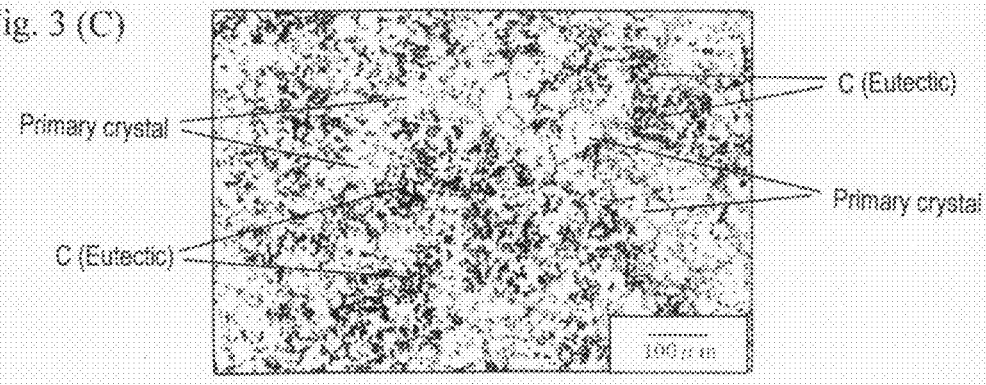

FIG. 3 are micrographs of composite metal structure of a metallic material for molding process, which is manufactured by inserting a vibration hone 20 mm in diameter to the semi-solid metallic material $M_3$, after subjected to stirring and kneading for 60 minutes in the same manner as in the intermediate as the dispersion process of the carbon nanomaterial, to intermittently apply ultrasonic vibration with a frequency of 20 kHz, an ultrasonic output of 1500 kW and an amplitude width of 20 μm, followed by solidification by cooling. The application time of ultrasonic vibration is 350 seconds in total of "application of vibration: 50 sec→stoppage of application: 10 sec→application of vibration: 150 sec→stoppage of vibration: 10 sec→application of vibration: 150 sec," and the white part in the composite metal structure is primary crystal, and the black part is the carbon nanomaterial C dispersed in eutectic structure.

FIG. 3(A) to (C) show the composite metal structure of this metallic material at a section of a ¼ part from the upper part, at a section of a ½ part from the upper part, and at a section of a ¾ part from the upper part, respectively. This composite metal structure is homogeneous as a whole, in which the solid phase (primary crystal) of the semi-solid metallic material is refined by ultrasonic vibration, and the lumps caused by coagulation of the carbon nanomaterial (refer to FIG. 2), which was caused by the compositing only through the stirring and kneading, are broken and disappeared. This shows that even a carbon nanomaterial of nm scale easy to coagulate can be uniformly dispersed through both the stirring and kneading and the application of ultrasonic vibration, and proves that the compositing of non-ferrous metal alloy with carbon nanomaterial which was considered to be difficult can be easily performed.

In the above-mentioned embodiment, after the metallic material is melted by heating to a liquidus temperature or higher, the metallic material is flowed down over the inclined cooling plate, whereby generation and spheroidization of solid phase in the semi-solid metallic material are performed. Besides, the spheroidization can be performed by holding the semisolid metallic material by heating to a solid-liquid coexisting temperature between a liquidus temperature or lower and a solidus temperature or higher, and granularly shearing the resulting solid phase by stirring. In this case, after the metallic material is molten into the partially molten state by heating the storage container 3 shown in FIG. 1 to the solid-liquid coexisting temperature by the electric furnace 31, and the granulation and spheroidization of solid phase are performed by stirring the semi-solid metallic material by the stirring bar 41, addition of the carbon nanomaterial and the stirring and kneading process are performed.

In this spheroidization of granular solid phase by stirring and shearing, although the grain size of solid phase is as large as 100 to 300 μm (melting temperature: 585° C., stirring time: 30 minutes, rotating speed: 500 rpm), compared with the spheroidization by flowing down over the inclined cooling plate, it never makes the subsequent stirring and kneading difficult since the average grain size is about 100 μm.

In the above-mentioned embodiment, although the ultrasonic vibration is applied after the stirring and kneading process of the carbon nanomaterial, the application of ultrasonic vibration can be performed simultaneously with the stirring. In this case, since the compositing treatment by ultrasonic vibration can be performed within the stirring time, the manufacturing time can be shortened.

What is claimed is:

1. A method for manufacturing a composite of a carbon nanomaterial and a metallic material, the method comprising:

compositing a metallic material of non-ferrous metal alloy with a carbon nanomaterial by adding the carbon nanomaterial in a state where the metallic material shows thixotropic properties by spheroidization of solid phase in a semi-solid state thereof, the compositing being performed by:

adding the carbon nanomaterial to the metallic material in the semi-solid state while stirring, shearing, and kneading the metallic material in the semi-solid state to granulate the solid phase in the semi-solid metallic material to a granular solid phase and to spheroidize the granular solid phase while maintaining the metallic material being stirred, sheared, and kneaded at a solid-liquid coexisting temperature; and dispersing uniformly the carbon nanomaterial into the liquid phase between solid phases while refining grains of the solid phases, by applying ultrasonic vibration to the metallic material in the semi-solid state after said stirring, shearing, and kneading or concurrent therewith.

2. The method for manufacturing a composite of a carbon nanomaterial and a metallic material according to claim 1, wherein the spheroidization of solid phase in the semi-solid state of the metallic material is performed in the process of cooling the metallic material into the semi-solid state by flowing down the metallic material, after melting it by heating to a temperature of a liquidus temperature or higher, over the plate surface of an inclined cooling plate.

3. The method for manufacturing a composite of a carbon nanomaterial and a metallic material according to claim 1, wherein the spheroidization of solid phase in the semi-solid state of the metallic material is performed by melting the metallic material to the semi-solid state by heating to a solid-liquid coexisting temperature between a liquidus temperature or lower and a solidus temperature or higher, and shearing the solid phase by stirring the semi-solid metallic material.

4. The method for manufacturing a composite of a carbon nanomaterial and a metallic material according to claim 1, wherein the stirring, shearing, and kneading is performed by the shearing the solid phase while stirring the semi-solid metallic material.

5. The method for manufacturing a composite of a carbon nanomaterial and a metallic material according to claim 1, wherein the dispersion process by ultrasonic vibration comprises continuously and intermittently applying ultrasonic vibration for 60 to 900 seconds successively to the stirring and kneading process.

6. The method for manufacturing a composite of a carbon nanomaterial and a metallic material according to claim 1, wherein the ultrasonic vibration is applied with a frequency of 5 to 30 kHz, an ultrasonic wave output of 500 to 3000 kW, an amplitude width of 5 to 30 μm, and a vibration application time of 60 to 900 seconds.

7. The method for manufacturing a composite of a carbon nanomaterial and a metallic material according to claim 1, wherein the non-ferrous metal alloy is a magnesium alloy, the granularized and spheroidized grains in solid phase of the semi-solid metallic material have a size of 50 to 300 μm, and a refined solid phase produced by refining the spheroidized solid phase has a size of 5 to 50 μm.

8. The method for manufacturing a composite of a carbon nanomaterial and a metallic material according to claim 1, wherein the carbon nanomaterial consists of carbon nanotubes or carbon nanofibers having a diameter of 10 to 150 nm and a length of 1 to 100 μm.

9. The method for manufacturing a composite of a carbon nanomaterial and a metallic material according to claim 1, in which the addition amount of the carbon nanomaterial is 0.1 to 20 mass %.

10. The method for manufacturing a composite of a carbon nanomaterial and a metallic material according to claim 1, wherein the carbon nanomaterial is preheated before being added to the semi-solid metallic material.

11. The method for manufacturing a composite of a carbon nanomaterial and a metallic material according to claim 1, wherein:

the spheroidization of solid phase in the semi-solid state of the metallic material is performed in the process of cooling the metallic material into the semi-solid state by flowing down the metallic material, after melting it by heating to a temperature of a liquidus temperature or higher, over the plate surface of an inclined cooling plate;

the dispersion process by ultrasonic vibration comprises continuously and intermittently assigning ultrasonic vibration for 60 to 900 seconds successively to the stirring and kneading process;

the ultrasonic vibration is assigned with a frequency of 5 to 30 kHz, an ultrasonic wave output of 500 to 3000 kW, an amplitude width of 5 to 30 μm, and a vibration application time of 60 to 900 seconds;

the non-ferrous metal alloy is a magnesium alloy, grains in solid phase of the semi-solid metallic material have a size of 50 to 300 μm, and the grains are refined to 5 to 50 μm by the ultrasonic vibration.

12. The method for manufacturing a composite of a carbon nanomaterial and a metallic material according to claim 1, wherein:

the stirring, shearing, and kneading process is performed by shearing the solid phase while stirring the semi-solid metallic material;

the carbon nanomaterial consists of carbon nanotubes or carbon nanofibers having a diameter of 10 to 150 nm and a length of 1 to 100 μm;

the addition amount of the carbon nanomaterial is 0.1 to 20 mass %;

the carbon nanomaterial is preheated before being added to the semi-solid metallic material.

* * * * *

UNITED STATES PATENT AND TRADEMARK OFFICE

CERTIFICATE OF CORRECTION

PATENT NO. : 7,837,811 B2
APPLICATION NO. : 11/803139
DATED : November 23, 2010
INVENTOR(S) : Tetsuichi Motegi et al.

It is certified that error appears in the above-identified patent and that said Letters Patent is hereby corrected as shown below:

Column 7, claim 4, line 4, “the shearing” should read --shearing--.

Signed and Sealed this
Thirteenth Day of March, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,837,811 B2
APPLICATION NO. : 11/803139
DATED : November 23, 2010
INVENTOR(S) : Tetsuichi Motegi et al.

It is certified that error appears in the above-identified patent and that said Letters Patent is hereby corrected as shown below:

Front page, (75) Inventors, "Tetsuichi Motegi, Narashino" should read --Tetsuichi Motegi, Narashino-shi--;

Front page, (75) Inventors, "Fumi Tanabe, Narashino" should read --Fumi Tanabe, Narashino-shi--; and Column 7, claim 4, line 4, "the shearing" should read --shearing--.

This certificate supersedes the Certificate of Correction issued March 13, 2012.

Signed and Sealed this
Fourteenth Day of August, 2012

David J. Kappos

David J. Kappos
*Director of the United States Patent and Trademark Office*